US010449663B2

(12) United States Patent
Martin

(10) Patent No.: US 10,449,663 B2
(45) Date of Patent: Oct. 22, 2019

(54) ERGONOMIC HANDLE DEVICE FOR HOLDING TOOLS

(71) Applicant: David Wayne Martin, Canton, NC (US)

(72) Inventor: David Wayne Martin, Canton, NC (US)

( * ) Notice: Subject to any disclaimer, the term of this patent is extended or adjusted under 35 U.S.C. 154(b) by 189 days.

(21) Appl. No.: 15/663,240

(22) Filed: Jul. 28, 2017

(65) Prior Publication Data

US 2018/0133890 A1 May 17, 2018

Related U.S. Application Data

(60) Provisional application No. 62/422,546, filed on Nov. 15, 2016.

(51) Int. Cl.

| | |
|---|---|
| ***B25G 1/10*** | (2006.01) |
| ***A46B 5/02*** | (2006.01) |
| ***A46B 17/02*** | (2006.01) |

(52) U.S. Cl.

CPC ..... *B25G 1/102* (2013.01); *A46B 5/02* (2013.01); *A46B 5/021* (2013.01); *A46B 17/02* (2013.01); *A46B 2200/202* (2013.01)

(58) Field of Classification Search

CPC ..... B25G 1/102; A46B 5/02; A46B 5/021; A46B 5/025

USPC ..... D8/107, 83

See application file for complete search history.

(56) References Cited

U.S. PATENT DOCUMENTS

| | | | | |
|---|---|---|---|---|
| 3,742,787 | A * | 7/1973 | Whiteford | B25B 13/465 81/438 |
| 4,035,865 | A | 7/1977 | McRae et al. | |
| 4,606,484 | A | 8/1986 | Winter et al. | |
| 4,617,697 | A | 10/1986 | David | |
| 5,470,162 | A | 11/1995 | Rubin | |
| D401,493 | S * | 11/1998 | Lin | D8/107 |
| 6,286,395 | B1 * | 9/2001 | Frazier | B25B 13/005 81/124.7 |
| 6,328,494 | B1 | 12/2001 | Moxon | |
| 7,240,527 | B2 * | 7/2007 | Boyd | E05B 1/0053 70/429 |
| 9,044,853 | B2 * | 6/2015 | Phui | B25G 1/102 |
| D807,693 | S * | 1/2018 | Obmaces | D7/393 |

(Continued)

*Primary Examiner* — David B. Thomas

(74) *Attorney, Agent, or Firm* — The Van Winkle Law Firm; William G. Heedy

(57) ABSTRACT

There is provided an ergonomic handle device for holding tools including an approximately spherical holder having an outer surface and surrounding three slots; any two of the three slots are perpendicular to each other; each of the three slots extends from a first end to a second end on two opposite sides of the approximately spherical holder, in a radial direction and through a center of the approximately spherical holder; each of the three slots being sized and configured for engaged receipt of a handle of the tool, wherein the handle of the tool passes through the first end of one of the three slots until the handle of the tool passes through the second end of the slot; a plurality of grip indentations on the outer surface of the approximately spherical holder; and wherein the user may operate the tool by gripping the grip indentations of the approximately spherical holder for an extended time without getting stiff hands and fingers.

15 Claims, 3 Drawing Sheets

(56) References Cited

U.S. PATENT DOCUMENTS

| | | | | |
|---|---|---|---|---|
| 2012/0167348 | A1* | 7/2012 | Adams | B25G 1/102<br>16/426 |
| 2018/0168379 | A1* | 6/2018 | Delaforce | A61F 4/00 |

* cited by examiner

ERGONOMIC HANDLE DEVICE FOR HOLDING TOOLS

CROSS-REFERENCE TO RELATED APPLICATION

This Application claims priority to and incorporates entirely by reference U.S. Provisional Application No. 62/422,546, filed on Nov. 15, 2016.

FIELD OF THE INVENTION

The present invention generally relates to the field of handle for tools and more specifically relates to a multi-purpose ergonomic handle device for holding tools.

DESCRIPTION OF THE RELATED ART

When users grip onto a tool handle for repetitive work, for example, painting houses or cutting foods, users' hands and fingers may become stiff from gripping onto the tool handle for an extended time. In the prior art, ergonomic handles with various contours are designed to help relieve the discomfort of the users' hands and fingers. Among these attempts are found in: U.S. Pat. No. 6,328,494 to William A. Moxon; U.S. Pat. No. 4,606,484 to Sybil B. A. Winter et al.; U.S. Pat. No. 4,617,697 to David Constant V.; U.S. Pat. No. 5,470,162 to Burton S. Rubin; and U.S. Pat. No. 4,035,865 to Lucy Theresa McRae et al. In those inventions, each ergonomic handle is particularly designed for a particular tool, but there is no one multi-purpose ergonomic device that is adapted to several tools.

BRIEF SUMMARY OF THE INVENTION

In accordance with one form of this invention there is provided a novel multi-purpose ergonomic handle device for holding tools and giving users more mobility and function in their operating hands. The ergonomic handle device for holding tools includes an approximately spherical holder having an outer surface and surrounding three slots; any two of the three slots are perpendicular to each other; each of the three slots extends from a first end to a second end on two opposite sides of the approximately spherical holder, in a radial direction and through a center of the approximately spherical holder; each of the three slots being sized and configured for engaged receipt of a handle of the tool, wherein the handle of the tool passes through the first end of one of the three slots until the handle of the tool passes through the second end of the slot; a plurality of grip indentations on the outer surface of the approximately spherical holder; and wherein the user may operate the tool by gripping the grip indentations of the approximately spherical holder for an extended time without getting stiff hands and fingers.

BRIEF DESCRIPTION OF THE DRAWINGS

The figures which accompany the written portion of this specification illustrate embodiments and method(s) of use for the present invention, an ergonomic handle device for holding tools, constructed and operative according to the teachings of the present invention.

As shown in FIG. 3, the knife and the paintbrush slots are perpendicular to each other.

As shown in FIG. 4, one slot is from the top to the bottom along z axis and the other slot is from the left to the right along x axis, respectively.

As shown in FIG. 5, the first slot is from the top to the bottom along z axis; the second slot is from the left to the right along x axis; and the third slot is from the front to the back along y axis, respectively.

The various embodiments of the present invention will hereinafter be described in conjunction with the appended drawings.

DETAILED DESCRIPTION OF THE INVENTION

In the present invention, an ergonomic handle device for holding tools is designed to give users more mobility and function in their operating hands. The ergonomic handle device comprises an approximately spherical, i.e. a ball shaped, holder that fits in the palm of a hand. Users may choose appropriate sizes of the approximately spherical holders according to the sizes of their hands. The approximately spherical holder provides a comfortable gripping for users to hold only slightly bending their finger joints. Additionally, the plurality of grip indentations on the outer surface of the approximately spherical holder are helpful for users to grip onto and to re-position their fingers, allowing users to work for an extended time without stiff hands and fingers. The ergonomic handle device contains several differently shaped slots running from one side to the other side in the radial direction and through the center of the approximately spherical holder. Each slot may keep one particular tool, such as a pen, eating utensil or paintbrush, in place for use, making the ergonomic handle device useful for multiple purposes.

Figure 1:
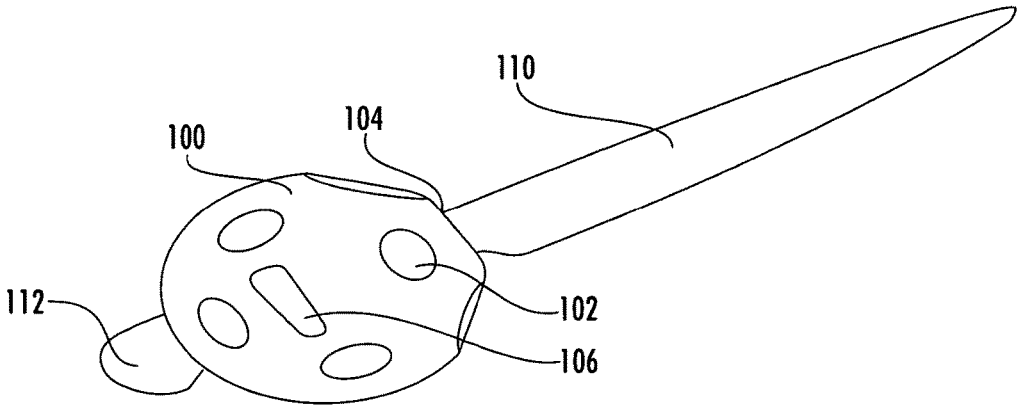
FIG. 1 shows the ergonomic handle device with a knife in place.

FIG. 1 shows an ergonomic handle device with a knife 110 in place. The ergonomic handle device comprises an approximately spherical holder 100 within which a knife slot 104 and a paintbrush slot 106 penetrate from one side to the other side in the radial direction and through the center of the approximately spherical holder 100. The knife handle 112 is inserted into the knife slot 104, from one end of the knife slot 104 until the knife handle 112 comes out of the other end of the knife slot 104.

The ergonomic handle device includes a plurality of grip indentations 102 on the outer surface of the approximately spherical holder 100. Those grip indentations 102 on which users' fingers are positioned provide more contact areas with users' fingers and create more friction so that less force is required for users to hold the tool, thus minimizing users' fatigue and discomfort during repetitive work. In the present invention, the sizes of the approximately spherical holder 100 vary to fit different hand sizes of users.

In some embodiments, the approximately spherical holder 100 is made of soft grip materials, for example, rubber, foam or other elastic materials. In other embodiments, the approximately spherical holder 100 is made of firm grip materials, for example, resilient plastics. In further embodiments, the approximately spherical holder 100 is manufactured by traditional injection molding, while in other embodiments the approximately spherical holder 100 is manufactured by 3D printing.

FIG. 1 also shows a paintbrush slot 106 within the approximately spherical holder 100. The paintbrush slot 106 is shaped like a slit that fits the handle of the paintbrush, and perpendicular to the knife slot 104. Such a design is the most efficient spatial design that meanwhile maintains the sturdiness of the approximately spherical holder 100.

Figure 2:
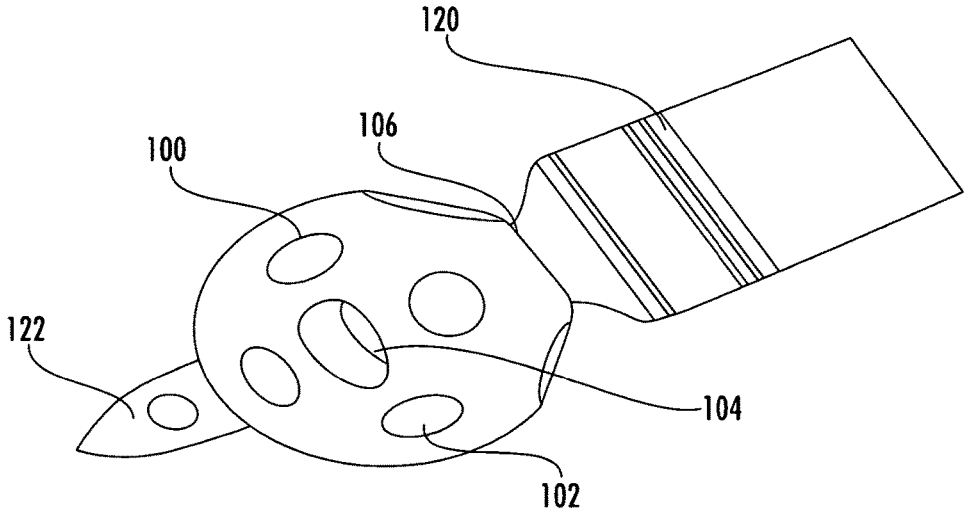
FIG. 2 shows the ergonomic handle device with a paintbrush in place.

FIG. 2 shows the ergonomic handle device with a paintbrush 120 in place. The paintbrush handle 122 is inserted into the paintbrush slot 106, from one end of the paintbrush slot 106 until the paintbrush handle 122 comes out of the other end of the paintbrush slot 106. Like the knife slot 104, the paintbrush slot 106 is a hole penetrating from one side to the other side, in the radial direction and through the center, of the approximately spherical holder 100. Approximate the slot ends of both the knife slot 104 and the paintbrush slot 106, a plurality of grip indentations 102 are on the outer surface of the approximately spherical holder 100, providing a comfortable gripping for users. As seen from FIG. 1 and FIG. 2, the shape of the knife slot 104 is more round compared to the slit-shaped paintbrush slot 106. In different embodiments, different slots are designed to fit different tools with particular shapes, making the ergonomic handle device multiple purpose.

In some embodiments, the paintbrush slot 106 is perpendicular to the knife slot 104, and both slots cross at the center of the approximately spherical holder 100. In other embodiments, the paintbrush slot 106 and the knife slot 104 cross each other at the center of the approximately spherical holder 100, with an intersecting angle between them greater than 0° and less than 90°. In further embodiments, there are several slots within the approximately spherical holder 100 cross each other at its center, with an intersecting angle between any two of the slots greater than 0° and less than 90°. In such embodiments, the number of the slots is limited without destroying the sturdiness of the approximately spherical holder 100.

Figure 3A:
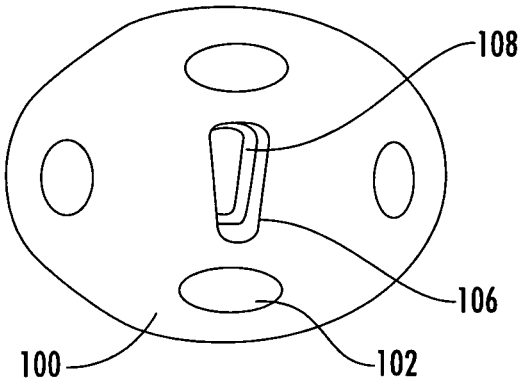
FIGS. 3(A) and 3(B) show two sides of the ergonomic handle device: the first side (A) on which one end of the paintbrush slot is in the middle and surrounded by four grip indentations, and the second side (B) on which one end of the knife slot is in the middle and surrounded by four grip indentations.
Figure 3B:
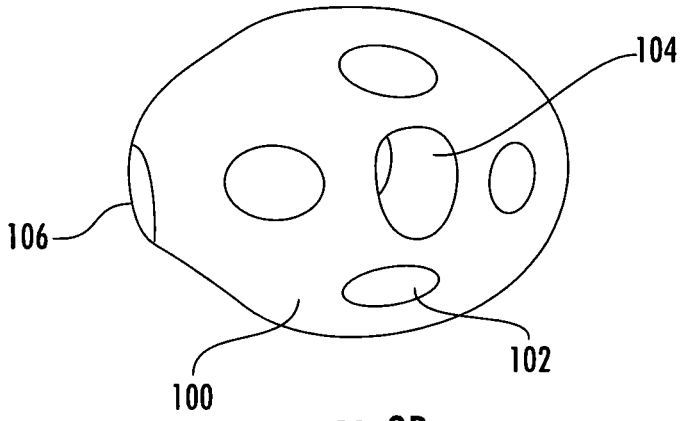

For a better illustration of the spatial relationship between the knife slot 104 and the paintbrush slot 106, the approximately spherical holder 100 without any tool in place is shown in FIG. 3. Facing the side of the approximately spherical holder 100 in FIG. 3(A), one end of the paintbrush slot 106 is located in the middle and surrounded by four grip indentations 102. In different embodiments, the number of the grip indentations 102 varies. From the end of the paintbrush slot 106 on the front side of the approximately spherical holder 100, one can see through the paintbrush slot 106 to the other end on the back side of the approximately spherical holder 100, as shown in FIG. 3(A). In the midpoint of the paintbrush slot 106, i.e. the center of the approximately spherical holder 100, there is a crossing space between the paintbrush slot 106 and the knife slot 104. An opening 108 on the knife slot 104 can be seen on one side of the inner surface of the paintbrush slot 106, as shown in FIG. 3(A). The other opening of the knife slot 104 is on the other side of the inner surface of the paintbrush slot 106, but not shown. Turning the approximately spherical holder 100 from the right to the left at an angle that is close to but less than 90°, one end of the knife slot 104 becomes to be located in the middle and surrounded by four grip indentations 102. Meanwhile, the end of the paintbrush slot 106 becomes to be on the farthest left side of the approximately spherical holder 100, as shown in FIG. 3(B).

Figure 4:
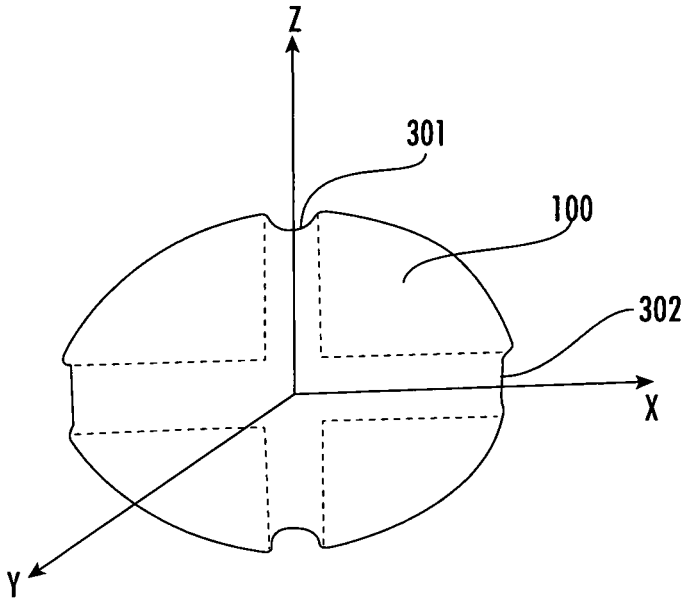
FIG. 4 shows the ergonomic handle device within which two slots that are perpendicular to each other and penetrate through the ergonomic handle device, in the radial direction and through the center of the approximately spherical holder.
Figure 5:
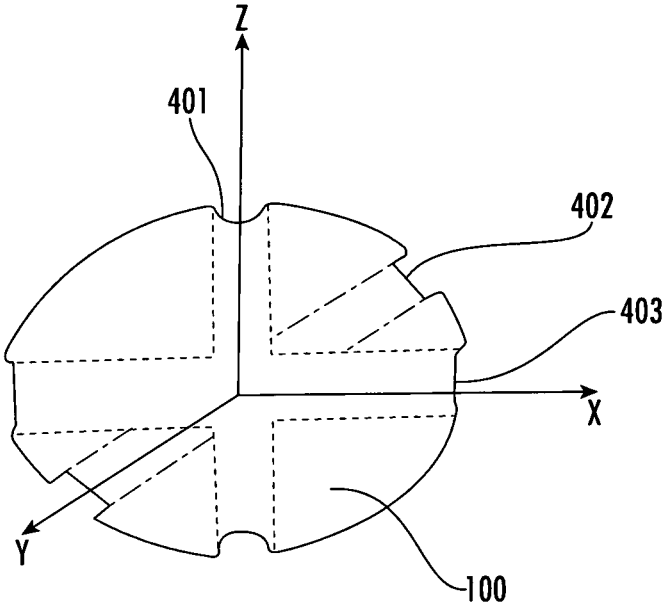
FIG. 5 shows the ergonomic handle device within which three slots, among which any two of these three slots are perpendicular to each other, penetrate through the ergonomic handle device, in the radial direction and through the center of the approximately spherical holder.

Next, two specific ergonomic handle devices are shown in FIG. 4 and FIG. 5. In FIG. 4, there are two slots that are perpendicular to each other within the approximately spherical holder 100; while in FIG. 5, there are three slots that any two of them are perpendicular to each other within the approximately spherical holder 100. For a better illustration of spatial relationship among the slots, the grip indentations 102 on outer surface of the approximately spherical holder 100 are not shown.

FIG. 4 shows an ergonomic handle device containing two slots that cross at the center of the approximately spherical holder 100. A first slot 301 is a hole running from the top to the bottom in the radial direction and through the center of the approximately spherical holder 100 and along with z axis. A second slot 302 is a hole running from the left to the right in the radial direction and through the center of the approximately spherical holder 100 and along with x axis. The first slot 301 is perpendicular to the second slot 302 because x and z axes are perpendicular to each other. The crossing space between two slots is at the center of the approximately spherical holder 100.

FIG. 5 shows an ergonomic handle device containing three slots that cross at the center of the approximately spherical holder 100. A first slot 401 is a hole running from the top to the bottom in the radial direction and through the center of the approximately spherical holder 100 and along with z axis. A second slot 402 is a hole running from the left to the right in the radial direction and through the center of the approximately spherical holder 100 and along with x axis. A third slot 403 is a hole running from the front to the back in the radial direction and through the center of the approximately spherical holder 100 and along with y axis. Since any two of x axis, y axis and z axis are perpendicular to each other, any two of slots are perpendicular to each other. The crossing space of the three slots is at the center of the approximately spherical holder 100 and bigger than the crossing space of two slots as shown in FIG. 4. The greater number of the slots is, the larger the crossing space is. Therefore, the number of the slots is limited by maintaining the sturdiness of the approximately spherical holder 100.

In one embodiment, the one or more of the slots are sized and shaped differently for receipt of a different tool on the same approximately spherical holder 100.

It should be appreciated that the approximately spherical holder 100 may be hollow wherein the slots are defined by the path between the corresponding first and second ends on two opposite sides of the approximately spherical holder 100.

The embodiments of the invention described herein are exemplary and numerous modifications, variations and rearrangements can be readily envisioned to achieve substantially equivalent results, all of which are intended to be embraced within the spirit and scope of the invention.

What is claimed is:

1. An ergonomic handle device for holding tools, said ergonomic handle device comprising:

an approximately spherical holder having an outer surface and surrounding three slots;

any two of said three slots are perpendicular to each other;

each of said three slots extends from a first end to a second end on two opposite sides of said approximately spherical holder, in a radial direction and through a center of said approximately spherical holder;

each of said three slots being sized and configured for engaged receipt of a handle of the tool, wherein the handle of the tool passes through the first end of one of said three slots until the handle of the tool passes through the second end of the slot;

a plurality of grip indentations on the outer surface of said approximately spherical holder; and wherein a user may operate the tool by gripping said grip indentations of said approximately spherical holder for an extended time without getting stiff hands and fingers.

2. The ergonomic handle device for holding tools as recited in claim 1, wherein one of said approximately spherical holder is sized and configured to fit within the palm of the user's hand.

3. The ergonomic handle device for holding tools as recited in claim 1, wherein at least one of said three slots is sized and configured for engaged receipt of a particularly shaped handle of a tool.

4. The ergonomic handle device for holding tools as recited in claim 3, wherein said tool is a pen.

5. The ergonomic handle device for holding tools as recited in claim 3, wherein said tool is a knife.

6. The ergonomic handle device for holding tools as recited in claim 3, wherein said tool is an eating utensil.

7. The ergonomic handle device for holding tools as recited in claim 3, wherein said tool is a paintbrush.

8. The ergonomic handle device for holding tools as recited in claim 1, wherein each of said three slots are sized and configured for receipt of a different tool.

9. An ergonomic handle device for holding tools, said ergonomic handle device for holding tools comprising:

an approximately spherical holder having an outer surface and surrounding two slots;

said two slots are perpendicular to each other;

each of said two slots extends from a first end to a second end on two opposite sides of said approximately spherical holder, in a radial direction and through a center of said approximately spherical holder;

each of said two slots being sized and configured for engaged receipt of a handle of the tool, wherein the handle of the tool passes through the first end of one of said two slots until the handle of the tool passes through the second end of the slot; and wherein a user may operate the tool by gripping onto said approximately spherical holder for an extended time without getting stiff hands and fingers.

10. The ergonomic hand device for holding tools as recited in claim 9 further comprising a plurality of grip indentations on the outer surface of said approximately spherical holder for gripping by the user.

11. The ergonomic handle device for holding tools as recited in claim 9, wherein each of said two slots are sized and configured for receipt of a different tool.

12. An ergonomic handle device for holding tools, said ergonomic handle device comprising:

an approximately spherical holder having an outer surface and surrounding at least one of a plurality of slots, wherein:

each of said plurality of slots extends from a first end to a second end on two opposite sides of said approximately spherical holder, in a radial direction and through a center of said approximately spherical holder;

each of said plurality of slots being sized and configured for engaged receipt of a handle of the tool, wherein the handle of the tool passes through the first end of one of said plurality of slots until the handle of the tool passes through the second end of the slot; and wherein a user may operate the tool by gripping onto said approximately spherical holder for an extended time without getting stiff hands and fingers.

13. The ergonomic handle device for holding tools as recited in claim 12, wherein an intersecting angle of any two of said plurality of slots crossing at the center of said approximately spherical holder is greater than 0° and less than or equal to 90°.

14. The ergonomic hand device for holding tools as recited in claim 12 further comprising a plurality of grip indentations on the outer surface of said approximately spherical holder for gripping by the user.

15. The ergonomic handle device for holding tools as recited in claim 12, wherein each of said plurality of slots are sized and configured for receipt of a different tool.

* * * * *